US010770846B2

(12) United States Patent
White

(10) Patent No.: US 10,770,846 B2
(45) **Date of Patent: *Sep. 8, 2020**

(54) ELECTRIC CONNECTOR WITH WIRE HOLDER

(71) Applicant: CommScope Connectivity UK Limited, Dorcan, Swindon (GB)

(72) Inventor: Gordon John White, Gloucester (GB)

(73) Assignee: CommScope Connectivity UK Limited, Dorcan (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/160,568

(22) Filed: Oct. 15, 2018

(65) Prior Publication Data

US 2019/0148896 A1 May 16, 2019

Related U.S. Application Data

(63) Continuation of application No. 15/942,758, filed on Apr. 2, 2018, now Pat. No. 10,103,504, which is a (Continued)

(51) Int. Cl.
*H01R 13/58* (2006.01)
*H01R 24/64* (2011.01)
(Continued)

(52) U.S. Cl.
CPC ..... *H01R 24/64* (2013.01); *H01R 13/5829* (2013.01); *H01R 13/6461* (2013.01); *H01R 43/20* (2013.01); *H01R 4/2429* (2013.01)

(58) Field of Classification Search
CPC .. H01R 13/58; H01R 13/595; H01R 13/5812; H01R 23/7973; H01R 23/025
(Continued)

(56) References Cited

U.S. PATENT DOCUMENTS

| | | | |
|---|---|---|---|
| 1,856,109 | A | 5/1932 | Bradley et al. |
| 4,148,539 | A | 4/1979 | Hardesty |
| 4,601,530 | A | 7/1986 | Coldren et al. |
| 4,950,176 | A | 8/1990 | Cocco et al. |

(Continued)

FOREIGN PATENT DOCUMENTS

| | | |
|---|---|---|
| DE | 10 2010 021 871 A1 | 12/2010 |
| EP | 0 793 305 A2 | 9/1997 |

OTHER PUBLICATIONS

International Search Report and Written Opinion of the International Searching Authority for corresponding International Patent Application No. PCT/EP2016/050189 dated Apr. 1, 2016, 9 pages.

(Continued)

*Primary Examiner* — Phuong Chi Thi Nguyen
(74) *Attorney, Agent, or Firm* — Merchant & Gould P.C.

(57) ABSTRACT

An electric connector is provided to ensure reliable termination of cable wires having different sizes. The electric connector can include a housing, a plurality of contacts, and a wire holder. The wire holder includes a wire support extension configured to be at least partially inserted into the housing. The wire support extension defines a plurality of wire receiving passages configured to arrange a plurality of first wires thereon and align the first wires with contact insert slots of the housing, respectively, when the wire support extension is inserted to the housing. The wire holder further includes a plurality of wire support ribs configured to centralize second wires smaller than the first wires.

17 Claims, 12 Drawing Sheets

Related U.S. Application Data continuation of application No. 15/542,016, filed as application No. PCT/EP2016/050189 on Jan. 7, 2016, now Pat. No. 9,935,411.

(60) Provisional application No. 62/100,766, filed on Jan. 7, 2015.

(51) Int. Cl.
*H01R 43/20* (2006.01)
*H01R 13/6461* (2011.01)
*H01R 4/2429* (2018.01)

(58) Field of Classification Search
USPC ..... 439/460, 469, 470, 472, 165, 660, 676
See application file for complete search history.

(56) References Cited

U.S. PATENT DOCUMENTS

| | | | | |
|---|---|---|---|---|
| 5,010,371 | A | 4/1991 | Matsuo et al. | |
| 5,186,649 | A | 2/1993 | Fortner et al. | |
| 6,010,371 | A | 1/2000 | Farley et al. | |
| 8,342,733 | B2 * | 1/2013 | Daily | H01R 12/721 362/249.01 |
| 9,444,159 | B2 * | 9/2016 | Lappoehn | H01R 4/2433 |
| 10,103,504 | B2 * | 10/2018 | White | H01R 24/64 |
| 2012/0202389 | A1 | 8/2012 | Erickson et al. | |

OTHER PUBLICATIONS

Commscope RJ-45 Connector Housing (Applicant Admitted Prior Art).

* cited by examiner

ELECTRIC CONNECTOR WITH WIRE HOLDER

CROSS-REFERENCE TO RELATED APPLICATION

This application is a Continuation of U.S. patent application Ser. No. 15/942,758, filed on Apr. 2, 2018, now U.S. Pat. No. 10,103,504 which is a Continuation of U.S. patent application Ser. No. 15/542,016, filed on Jul. 6, 2017, now U.S. Pat. No. 9,935,411, which is a National Stage of Application of PCT/EP2016/050189, filed on Jan. 7, 2016, which claims the benefit of U.S. Patent Application Ser. No. 62/100,766, filed on Jan. 7, 2015, the disclosures of which are incorporated herein by reference in their entireties. To the extent appropriate, a claim of priority is made to each of the above disclosed applications.

BACKGROUND

Electric connectors, such as modular plugs, are typically used to transmit digital signals in telephonic and other data communication systems where high performance through reduced electromagnetic interference between conductors (i.e., crosstalk) is desirable and necessary. Modular plugs, one type of electric connectors, are typically terminated by technicians in the field, or prepared in assembly lines of a factory. In certain examples, a cable that is to be terminated in the modular plug includes insulated, multi-colored wires wrapped by an insulating cable jacket. The cable typically includes eight wires that are made into a bundle of four twisted pairs. The bundle may optionally include a drain wire or surrounding shield for use in a shielded plug.

To prepare the cable for termination in the plug, the cable jacket is first peeled back to expose the insulated pairs. After that, with the several insulated wires exposed, the wires can be untwisted and arranged in the desired order, generally in a side-by-side fashion. The wires can then be individually inserted into a plug housing and terminated by an insulation piercing blade. The wires can be misaligned and unsecured within the plug housing because the wires need to be independently engaged into the plug housing.

Some modular plugs employ a load bar or wire holder configured to hold the wires in an array and be inserted into the housing. The wire holder allows the wires to be presented in alignment below insulation piercing contacts when the wire holder is placed into the housing. The wire holder can define a plurality of wire support passages to arrange the wires in a side-by-side manner thereon and provide a lateral alignment of the wires below the insulation piercing contacts when the wire holder is received into the housing. The wire support passages of the wire holder operate to centralize the wires with the insulation piercing contacts so that the insulation piercing contacts properly pierce the wires to make contact with the conductors within the wires. However, the wire support passages are dimensioned to fit wires of a particular size, and thus cannot function to centralize and align wires of different sizes with the insulation piercing contacts.

SUMMARY

In general terms, this disclosure provides an electric connector that can be easily assembled with cable wires by ensuring proper positioning of the wires during assembly.

In certain examples, an electric connector in accordance with the principles of the present disclosure includes a housing, a plurality of contacts, and a wire holder. The housing includes an extension receiving cavity and a plurality of contact insert slots. The plurality of contacts is configured to be at least partially inserted to the plurality of contact insert slots. The wire holder includes a wire support extension configured to be at least partially inserted to the extension receiving cavity. The wire support extension defines a plurality of wire receiving passages configured to be aligned to the plurality of contact insert slots when the wire support extension is inserted to the extension receiving cavity. The plurality of wire receiving passages is configured to arrange wires of a cable thereon and align the wires of the cable with the plurality of contact insert slots. The wire holder may include a plurality of wire support ribs at least partially arranged on the plurality of wire receiving passages. The wire support ribs are configured to arrange wires of a cable on the plurality of wire receiving passages and align the wires of the second cable with the plurality of contact insert slots.

In other examples, an electric connector in accordance with the principles of the present disclosure includes a housing, a plurality of contacts, and a wire holder. The housing includes an extension receiving cavity and a plurality of contact insert slots. The plurality of contacts is configured to be at least partially inserted to the plurality of contact insert slots. The wire holder includes a wire support extension configured to be at least partially inserted to the extension receiving cavity. The wire support extension includes a plurality of wire receiving passages configured to be aligned to the plurality of contact insert slots when the wire support extension is inserted to the extension receiving cavity. The extension receiving cavity defines a plurality of wire channels with the plurality of wire receiving passages of the wire holder. The plurality of wire channels is configured to receive wires of a cable and terminate at a plurality of inner mating portions configured to engage forward ends of the wires of the cable. Each of the plurality of inner mating portions being conically tapered.

In certain examples, an electric connector includes a housing, a plurality of contacts, and a wire holder. The housing has a cavity and a plurality of contact insert slots being in communication with the cavity. The plurality of contacts is at least partially inserted to the plurality of contact insert slots. The wire holder includes a wire support extension configured to be at least partially inserted into the cavity of the housing and placed below the plurality of contact insert slots. The wire support extension defines a plurality of wire receiving passages configured to arrange a plurality of wires of a first cable thereon and align the wires with the contact insert slots, respectively, when the wire support extension is inserted to the cavity of the housing. The wire holder may further include a plurality of wire support ribs at least partially arranged on the plurality of wire receiving passages to centralize wires of a second cable that has a size (e.g., a diameter) smaller than that of the wires of the first cable. The plurality of wire support ribs may arrange the smaller wires in place of the larger wires on the plurality of wire receiving passages, thereby aligning the smaller wires with the contact insert slots.

In addition, or alternatively, the electric connector may include a plurality of inner mating portions formed in the housing adjacent the plurality of wire receiving passages of the wire holder that is fully inserted into the housing. The inner mating portions are configured to engage forward ends of wires of a cable disposed on the plurality of wire receiving passages of the wire holder and align the cable wires with the contact insert slots. In certain examples, the plurality of inner mating portions is conically tapered to engage forward ends of wires having different sizes.

In addition, or alternatively, the wire holder may include a first alignment portion, such as an alignment protrusion, and the housing may include a second alignment portion, such as an alignment groove, corresponding to the first alignment portion. The first and second alignment portions are engaged to arrange the wire holder in place within the housing as the wire holder is inserted into the housing so that cable wires disposed on the wire holder are aligned with the contact insert slots of the housing.

Accordingly, the electric connector in accordance with the present disclosure may securely arrange and align cable wires of different sizes with the plurality of contacts.

DETAILED DESCRIPTION

Figure 1:
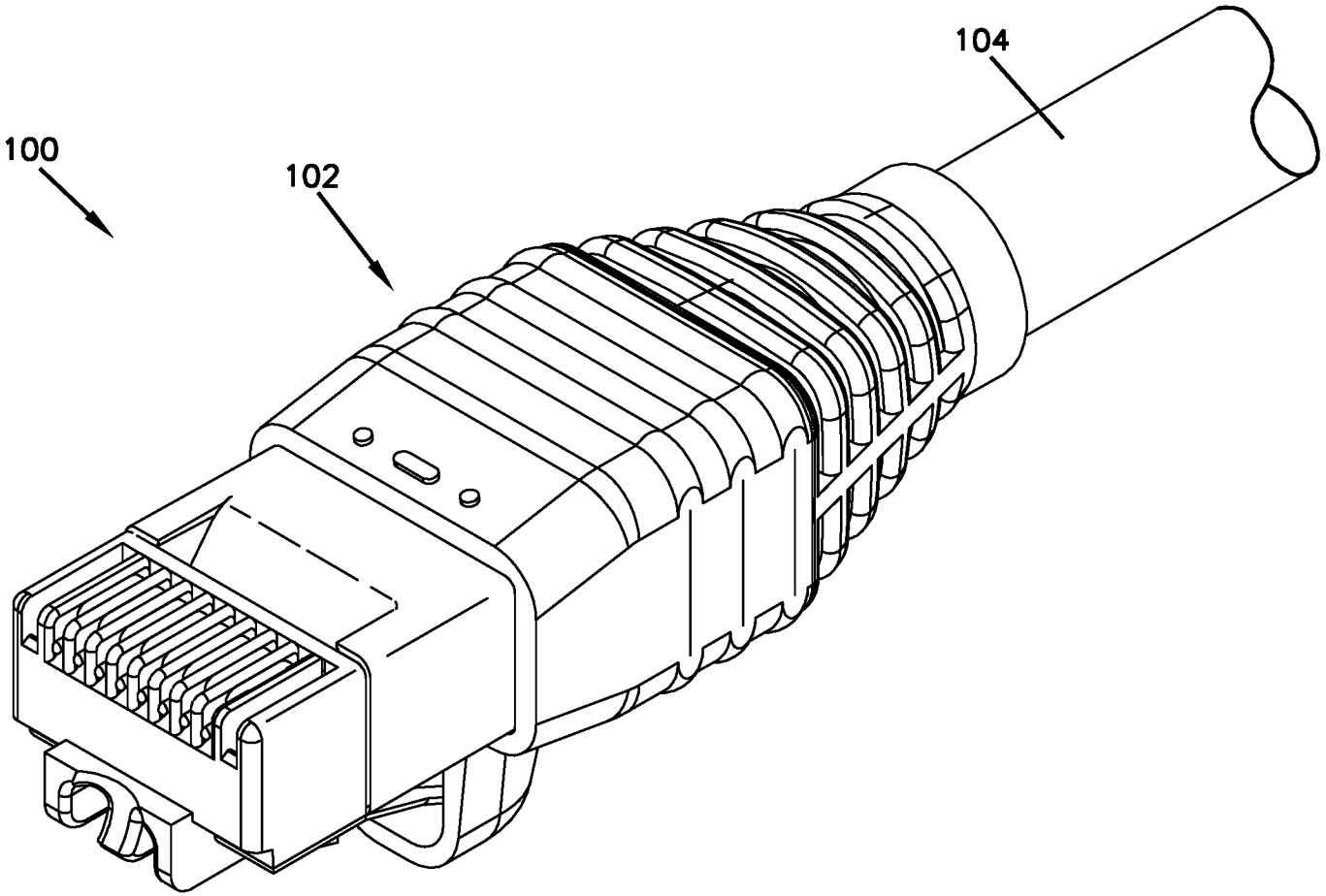
FIG. 1 is a perspective view of an example electric connector assembly.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

As described herein, an electric connector in accordance with the principles of the present disclosure includes a housing, a plurality of contacts, and a wire holder. The housing includes an extension receiving cavity and a plurality of contact insert slots. The plurality of contacts is configured to be at least partially inserted to the plurality of contact insert slots. The wire holder includes a wire support extension configured to be at least partially inserted to the extension receiving cavity. The wire support extension defines a plurality of wire receiving passages configured to be aligned to the plurality of contact insert slots when the wire support extension is inserted to the extension receiving cavity. The plurality of wire receiving passages is configured to arrange wires of a cable thereon and align the wires of the cable with the plurality of contact insert slots. The wire holder may include a plurality of wire support ribs at least partially arranged on the plurality of wire receiving passages. The wire support ribs are configured to arrange wires of a cable on the plurality of wire receiving passages and align the wires of the second cable with the plurality of contact insert slots.

In other examples, an electric connector in accordance with the principles of the present disclosure includes a housing, a plurality of contacts, and a wire holder. The housing includes an extension receiving cavity and a plurality of contact insert slots. The plurality of contacts is configured to be at least partially inserted to the plurality of contact insert slots. The wire holder includes a wire support extension configured to be at least partially inserted to the extension receiving cavity. The wire support extension includes a plurality of wire receiving passages configured to be aligned to the plurality of contact insert slots when the wire support extension is inserted to the extension receiving cavity. The extension receiving cavity defines a plurality of wire channels with the plurality of wire receiving passages of the wire holder. The plurality of wire channels is configured to receive wires of a cable and terminate at a plurality of inner mating portions configured to engage forward ends of the wires of the cable. Each of the plurality of inner mating portions being conically tapered.

FIG. 1 is a perspective view of an example electric connector assembly 100. The electric connector assembly 100 includes an electric connector 102 and a cable 104.

As used herein, the word "front" or "forward" corresponds to an end of the electric connector assembly 100 where the contacts 114 are arranged, and the word "rear," "rearward," or "back" corresponds to the direction opposite to the end of the trigger mechanism where the contacts 114 are located.

The electric connector 102 is configured to ensure reliable termination of cable wires having different sizes. The electric connector 102 can receive and arrange a plurality of wires 106 (FIG. 6) of different sizes (e.g., diameters) therein to be aligned with a plurality of contacts. An example electric connector 102 is illustrated and described in more detail with reference to FIG. 2.

Figure 6:
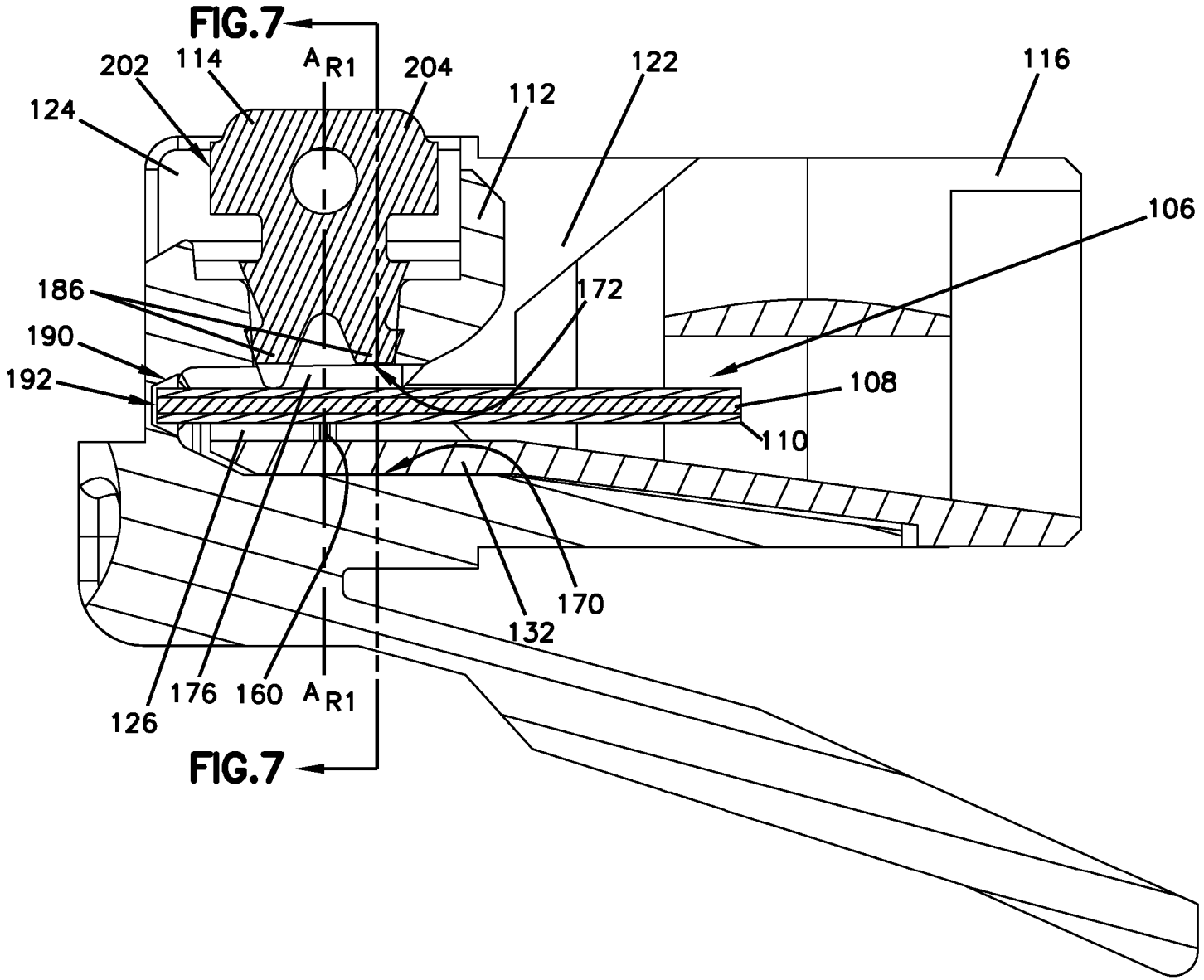
FIG. 6 is a side cross-sectional view of an assembly of a housing, contacts, and the wire holder engaging a cable.

The cable 104 is terminated in the electric connector 102. The cable 104 includes a plurality of wires 106 (FIG. 6). In some embodiments, the cable 104 includes eight multicolored wires that are made into a bundle of four twisted pairs. As shown in FIG. 6, each of the wires 106 can include an inner conductive core 108 and an outer insulating layer 110 surrounding the inner conductive core 108.

Figure 2:
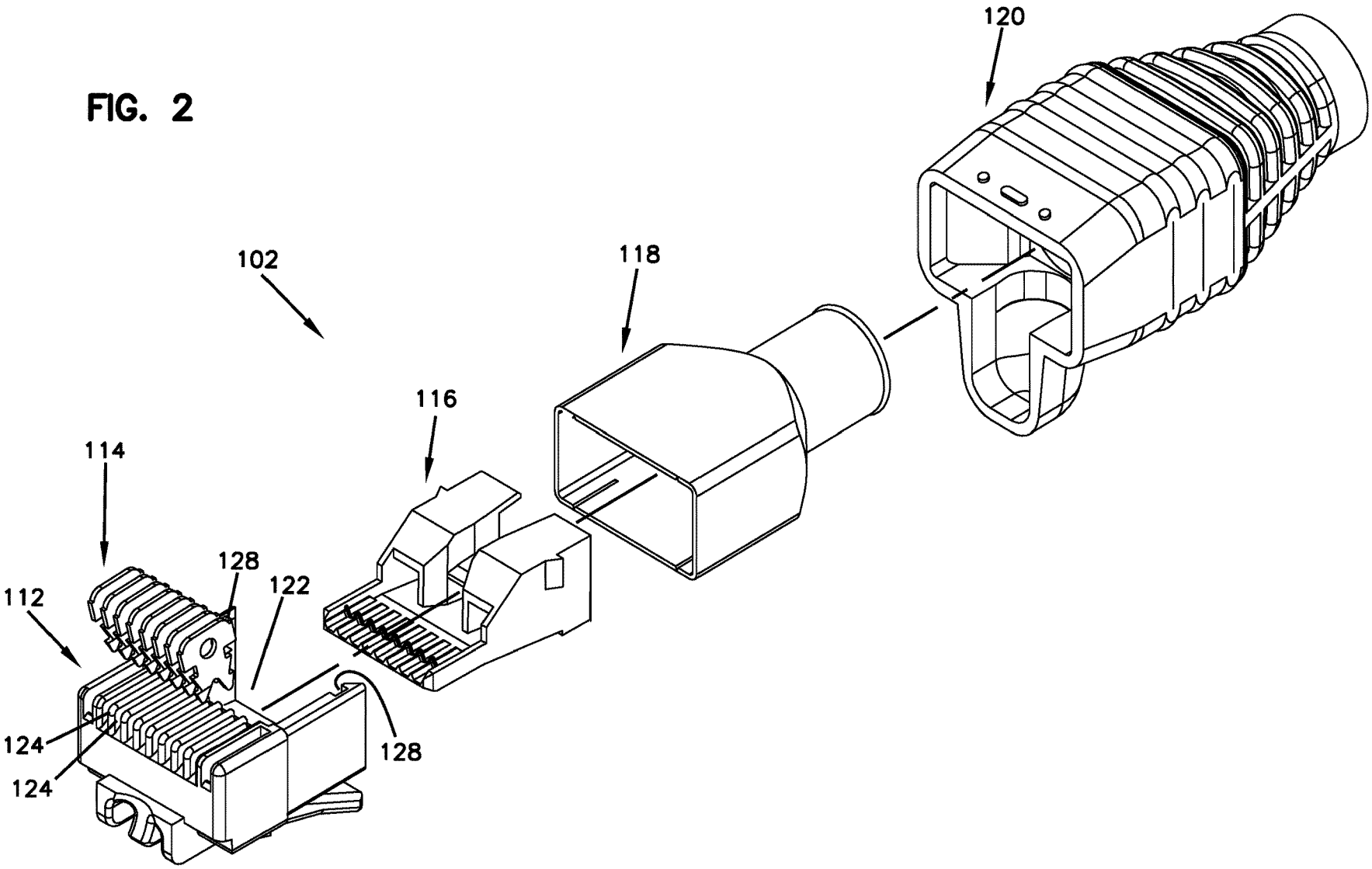
FIG. 2 is an exploded view of the electric connector of FIG. 1.

FIG. 2 is an exploded view of the electric connector 102 of FIG. 1. The electric connector 102 may include a housing 112, a plurality of contacts 114, a wire holder 116, a shield cap 118, and a strain relief boot 120.

The housing 112 is configured to receive the plurality of contacts 114 and the wire holder 116 aligning the wires 106 of the cable 104. The housing 112 defines a housing cavity 122 and a plurality of contact insert slots 124. As shown in FIG. 6, the housing cavity 122 includes an extension receiving cavity 126. The housing cavity 122 is configured to receive and support the wire holder 116 with the extension receiving cavity 126 receiving a wire support extension 132 of the wire holder 116, as described below. The plurality of contact insert slots 124 is configured to at least partially receive the plurality of contacts 114, respectively. The housing 112 may further include one or more grooves 128 configured to secure the wire holder 116 when the wire holder 116 is received in the housing 112.

The contacts 114 are at least partially inserted into the contact insert slots 124 and adapted to be pressed toward the housing cavity 122 once the wire holder 116 conveying the wires 106 of the cable 104 is inserted into the housing cavity 122 for termination. As described below, when the wires 106 of the cable 104 is received in the wire receiving passages 156 positioned on the wire support extension 132, the contacts 114 are further pressed into the contact insert slots 124 to pierce through the insulating layers 110 of the wires 106 and engage and terminate to the conductive cores 108 of the wires 106, respectively. An example of the contacts 114 is illustrated and described in more detail with reference to FIG. 6.

The conductive cores 108 may be made of copper, aluminum, copper-clad steel, plated copper, or other electrically conductive materials. Some example materials that may be used to manufacture the insulating layer 110 include plastic material, such as polyvinyl chloride (PVC), polyethylene, fluoropolymers (e.g. ethylenechlorotrifluorothylene (ECTF) and Flurothylenepropylene (FEP)), or other electrically insulating materials.

The wire holder 116 operates to support and convey the wires 106 of the cable 104 into the housing 112 for termination. The wire holder 116 is configured to centralize and align the wires 106 of the cable 104 with the contacts 114 (and/or the contact insert slots 124) when the contacts 114 are pressed onto the wire 106 through the contact insert slots 124, thereby ensuring an electrical contact between the contacts 114 and the conductive cores 108 of the wires 106, respectively. As described below, the wire holder 116 is adapted to align wires 106 of different sizes. An example wire holder 116 is illustrated and described in more details with reference to FIG. 3.

The shield cap 118 is configured to at least partially cover the housing 112, the wire holder 116, and/or electrical components contained therein. The shield cap 118 is used to reduce alien crosstalk between adjacent electric connectors 102.

The strain relief boot 120 engages the shield cap 118 and a least a portion of the housing 112 containing the wire holder 116 at the rearward end. The strain relief boot 120 provides strain relief to the cable 104 received within the housing 112.

Figure 3:
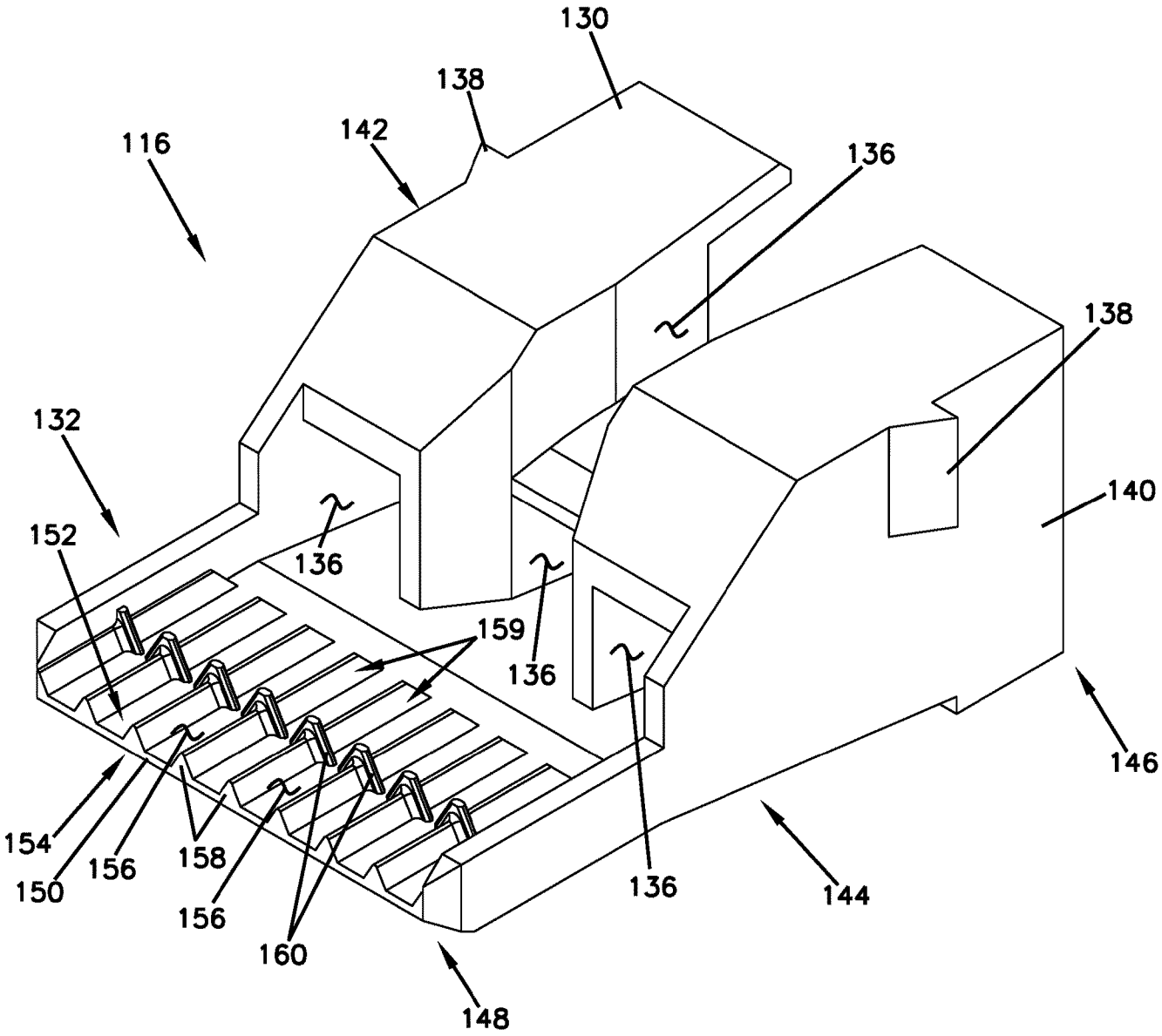
FIG. 3 is a top perspective view of an example wire holder.

FIG. 3 is a top perspective view of an example wire holder 116. The wire holder 116 includes a holder body 130 and a wire support extension 132.

The holder body 130 is configured to be inserted into the housing cavity 122. In some embodiments, the holder body 130 defines one or more wire insert channels 136 through which the wires 106 of the cable 104 are inserted before the wires 106 are disposed on the wire support extension 132. In the illustrated example, the holder body 130 has four wire insert channels 136, each of which receives a twisted pair of wires therethrough.

The holder body 130 may include one or more coupling tabs 138 for securing the holder body 130 in the housing cavity 122 of the housing 112. In some embodiments, the coupling tabs 138 are formed on side walls 140 and 142 and extend further outwardly than the width of the housing cavity 122 such that there is an interference fit between the coupling tabs 138 of the holder body 130 and the grooves 128 (FIG. 1) of the housing 112.

The wire support extension 132 extends from the holder body 130. For example, the wire support extension 132 extends from a forward end 144 of the holder body 130 and has a wire trimming end 148 opposite to the forward end 144 of the holder body 130. The wire support extension 132 is configured to be at least partially inserted into the extension receiving cavity 126 (FIG. 6) of the housing 112 and positioned below the contact insert slots 124 of the housing 112.

The wire support extension 132 has a base portion 150 having two opposite surfaces, such as a top surface 152 and a bottom surface 154. The wire support extension 132 includes a plurality of wire receiving passages 156 formed on the top surface 152 of the base portion 150 and configured to be aligned to the contact insert slots 124 of the housing 112, respectively, when the wire support extension 132 is inserted into the extension receiving cavity 126. Cooperating with a plurality of centralizing ribs 160, the wire receiving passages 156 are configured to centralize wires 106 of different diameters along middle axes A (FIG. 7) that are aligned with the contacts 114, respectively.

The wire receiving passages 156 may be defined by a plurality of base protrusions 158 extending from the top surface 152 of the base portion 150 and arranged in parallel. In the illustrated example, the base protrusions 158 have tapered lateral surfaces 159 to substantially form a triangular cross section (e.g., the wire receiving passages 156 is wider at the top than at the bottom thereof) so that the wires 106 of the cable 104 are abutted onto the tapered lateral surfaces 159. The base protrusions 158 can thus enable the wires 106 to be easily and securely placed on the wire receiving passages 156. As described below, the wire receiving passages 156 are shaped and dimensioned to support and align (i.e., centralize) wires 106 having a first diameter. In the illustrated example, the wire support extension 132 has eight wire receiving passages 156 for supporting eight wires 106.

Figure 7:
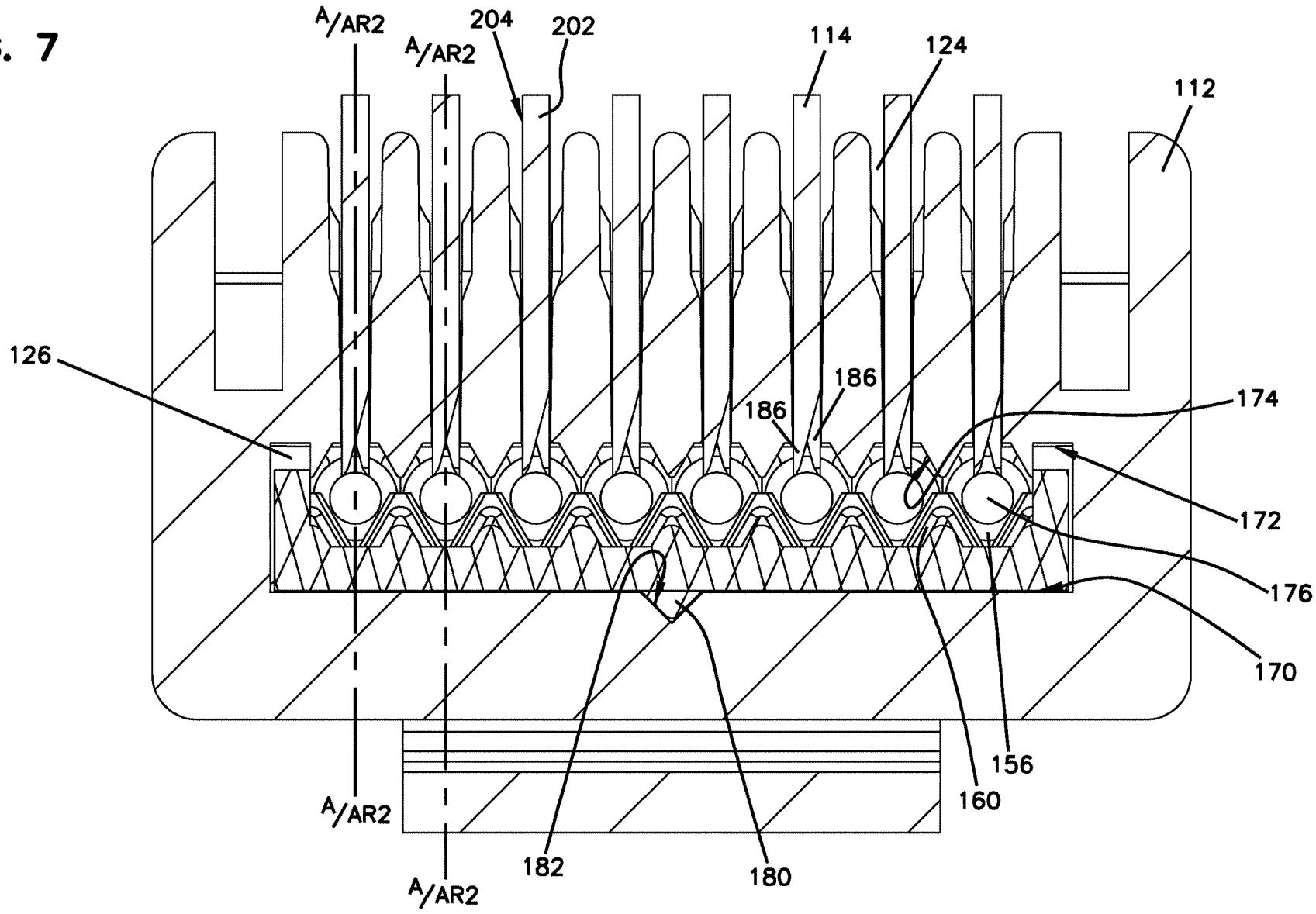
FIG. 7 is a rear cross-sectional view of the assembly of FIG. 6 without the cable.

The wire support extension 132 further includes a plurality of centralizing ribs (which is also referred to herein as wire support ribs) 160 at least partially arranged on the wire receiving passages 156 to support wires 106 of a second diameter that is smaller than the first diameter. The centralizing ribs 160 are configured such that a width of the wire receiving passage 156 is defined smaller between adjacent centralizing ribs 160 within the wire receiving passages 156 than between corresponding adjacent base protrusions 158. As shown in FIG. 7, a middle point (or center line) $A_{R2}$ between adjacent centralizing ribs 160 is in line with the middle axis A that is aligned with a center line of a front side 202 of the associated contact 114. Thus, the centralizing ribs 160 helps centralizing the wires 106 of the second diameter along the middle axes A. In some embodiments, the centralizing ribs 160 are formed at least partially around the base protrusions 158, respectively. Further, the centralizing ribs 160 can be shaped to be thin enough to be embedded into the outer insulating layers 110 of the wires 106.

Further, as shown in FIG. 6, the centralizing ribs 106 can be aligned with a center line $A_{R1}$ of a lateral side 204 of the contacts 114. In addition to aligning a wire of the second diameter, the centralizing ribs 160 can operate to centralize wires of various diameters along the center line of the contacts 114 (i.e., the middle axis A). As described herein, where the twisted pairs of wires are terminated with the connector assembly 100, an operator or technician at the field will straighten the twisted wires and place them onto the wire support extension 132 of the wire holder 116 for termination. In some occasions, at least one of the twisted wires is not fully flattened and can remain at least partially twisted within the associated wire channel 176 when the wire holder 116 is inserted into the housing 112. The centralizing ribs 160 that are aligned with the center line $A_{R1}$ of the lateral side 204 of the contacts 114 (FIG. 6), as well as with the center line $A_{R2}$ of the front side of the contacts 114 (FIG. 7), operate to align a portion of such at least partially twisted wires with the center of the contacts 114 (at the middle of two opposing insulation piercing tips 186 of each contact 114) in both planes (e.g., along the axes $A_{R1}$ and $A_{R2}$), thereby ensuring the contacts 114 to pierce into the associated wires.

In the illustrated example, one centralizing rib 160 is formed around each base protrusion 158. In other embodiments, a plurality of centralizing ribs 160 can be formed around each base protrusion 158. For example, two or more centralizing ribs 160 are arranged around each base protrusion 158 and spaced apart from each other along the length of the base protrusion 158. In some embodiments, such multiple centralizing ribs 160 for each base protrusion 158 can be equally spaced apart along the base protrusion 158. Other embodiments are also possible.

Figure 4:
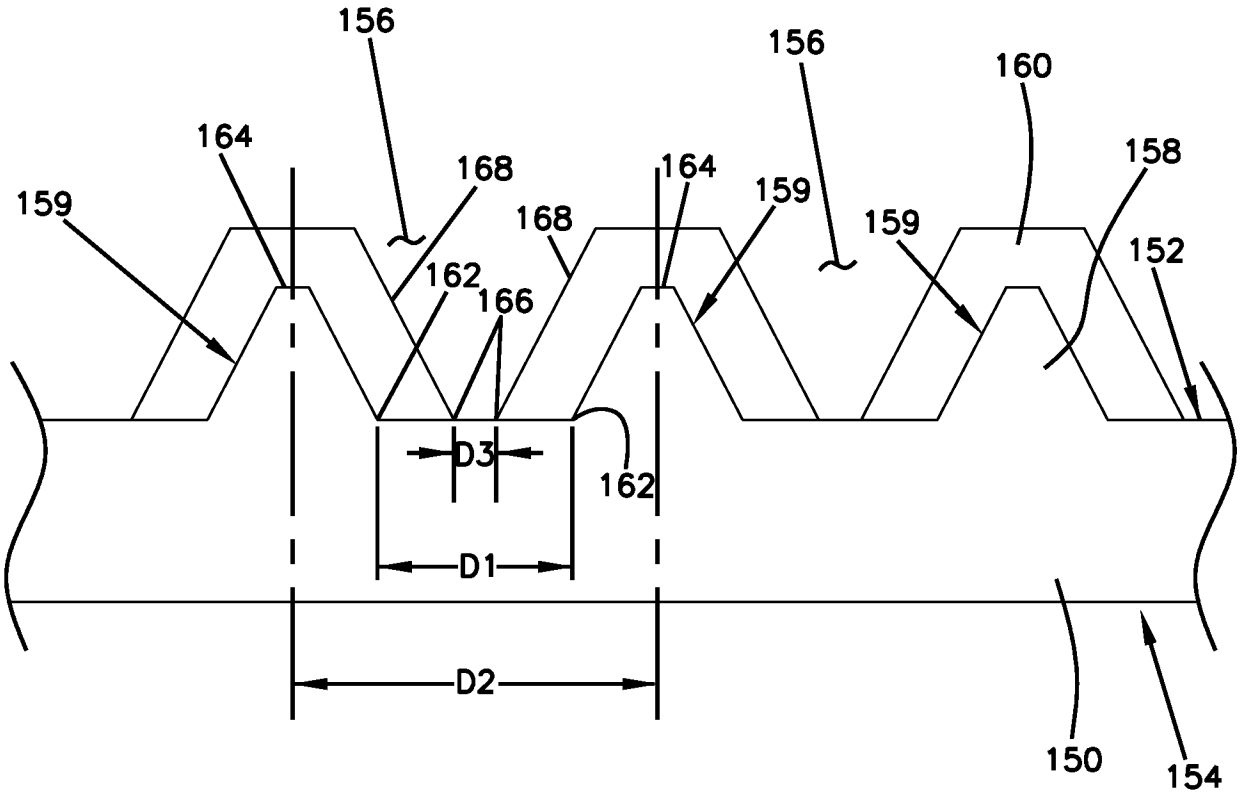
FIG. 4 illustrates an exploded cross-sectional view of a base portion of the wire holder of FIG. 3.

FIG. 4 illustrates an exploded cross-sectional view of the base portion 150, illustrating example geometry of the wire support extension 132. As described above, the wire support extension 132 defines the wire receiving passages 156 configured to support and align wires 106 of different dimensions, respectively.

In some embodiments, the wire receiving passages 156 defined by the base protrusions 158 can secure wires 106 having a diameter ranging, for example, between D1 and D2. The distance D1 is a distance between lower edges 162 of adjacent base protrusions 158, and the distance D2 is a distance between middle points 164 of the adjacent base protrusions 158. If the diameter of a wire 106 is larger than the distance D2, the wire 106 does not contact the tapered lateral surfaces 159, but can contact adjacent wires 106. The adjacent wires 106 thus can interface with each other and do not securely seat on the wire receiving passages 156. In other embodiments, the wire receiving passages 156 can secure the wire 106 having a diameter slightly larger than the distance D2 because the outer insulating layers 110 can be compressed without interfering with alignment of the wires 106 when adjacent wires 106 are abutted each other. If the diameter of a wire 106 is smaller than the distance D1, the wire 106 does not contact both of the tapered lateral surfaces 159 and can float between the tapered lateral surfaces 159 within the wire receiving passage 156 if there are no centralizing ribs 160.

The centralizing ribs 160 can help securing wires 106 having a diameter ranging, for example, between D3 and D1. The distance D3 is a distance between lower edges 166 of adjacent centralizing ribs 160. If the diameter of a wire 106 is smaller than the distance D3, the wire 106 does not engage both of opposing sides 168 of the adjacent centralizing ribs 160 and can float between the opposing sides 168 of the adjacent centralizing ribs 160.

Accordingly, the wire receiving passages 156 with the centralizing ribs 160 can support and centralize wires 106 having a diameter, for example, between the distances D2 (i.e., a distance between the middle points 164 of adjacent base protrusions 158) (or slightly larger than D2) and D3 (i.e., a distance between the lower edges 166 of adjacent centralizing ribs 160).

In the illustrated example, the centralizing ribs 160 have a cross section that resembles the cross section of the base protrusions 158. For example, similarly to the base protrusions 158, the centralizing ribs 160 substantially form a triangular cross-section (e.g., each rib 160 has a width wider at its top than at its bottom). However, in other embodiments, the centralizing ribs 160 can have different shapes. For example, at least one of the centralizing ribs 160 can have a rounded cross section. In other examples, at least one of the centralizing ribs 160 has a polygonal cross section.

Figure 5:
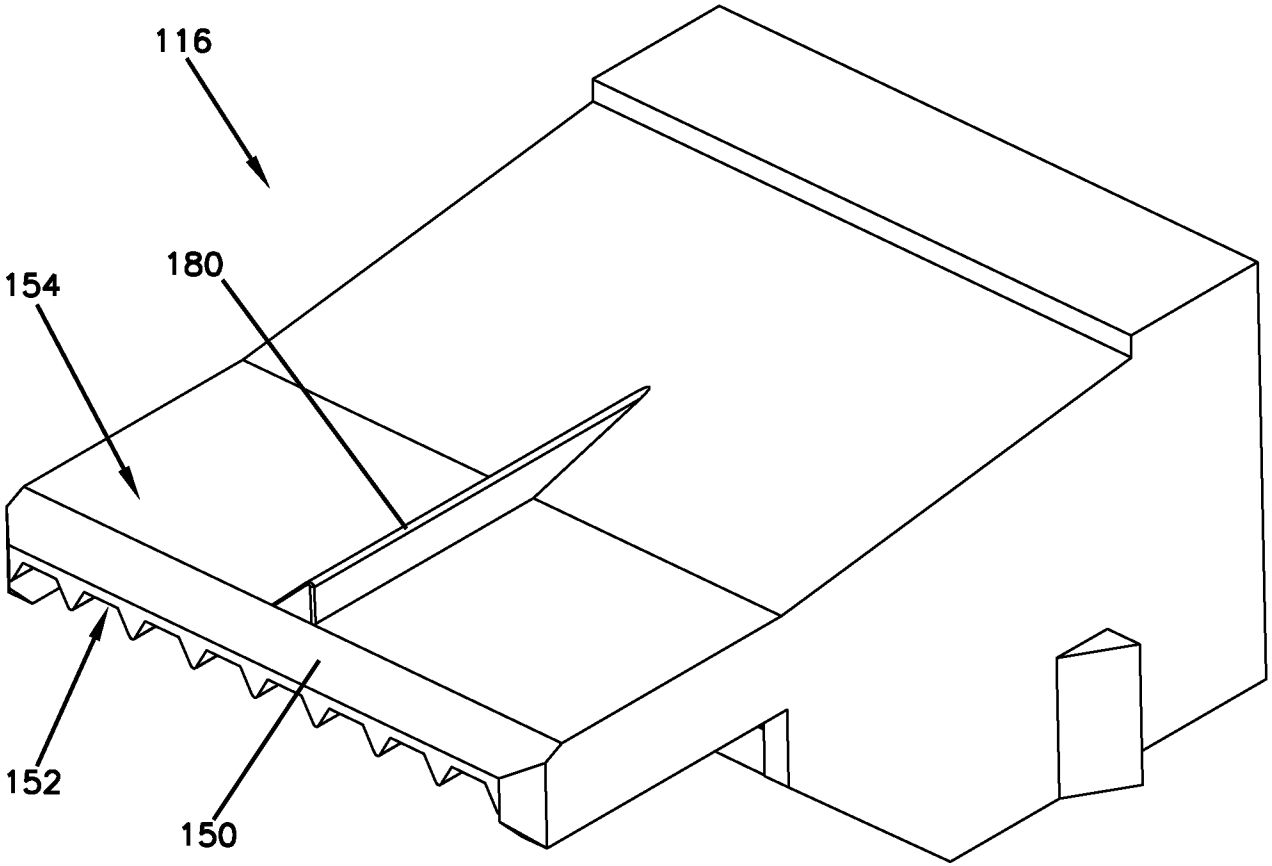
FIG. 5 is a bottom perspective view of the wire holder of FIG. 3.

FIG. 5 is a bottom perspective view of the wire holder 116 of FIG. 3. The wire holder 116 includes a first alignment portion 180 configured to correspondingly engage a second alignment portion 182 (FIG. 6) formed in the housing 112 when the wire holder 116 is disposed within the housing 112. The first and second alignment portions 182 and 182 are configured to align the wire holder 116 in place within the housing cavity 122. For example, the first and second alignment portions 180 and 182 are engaged with each other when the wire support extension 132 of the wire holder 116 is inserted into the extension receiving cavity 126 of the housing 112 to align the plurality of contact insert slots 124 with the plurality of wire receiving passages 156 of the wire holder 116 along the middle axes A (FIG. 7).

In some embodiments, the first alignment portion 180 includes an alignment protrusion, and the second alignment portion 182 includes an alignment groove corresponding to the alignment protrusion. The alignment groove of the housing 112 is configured to engage the alignment protrusion of the wire holder 116 when the wire support extension 132 of the wire holder 116 is inserted into the extension receiving cavity 126 of the housing 112 to align the contact insert slots 124 with the wire receiving passages 156 of the wire holder 116. The alignment protrusion, as the first alignment portion 180 can be formed on the bottom surface 154 of the base portion 150.

In other embodiments, the first and second alignment portions 180 and 182 have different corresponding shapes. For example, the first alignment portion 180 can include a groove, and the second alignment portion 182 can include a corresponding protrusion. Other embodiments are also possible.

In some embodiments, the first and second alignment portions 180 and 182 can be designed to have tolerances such that the first alignment portion 180 slightly interferes with the second alignment portion 182 in engagement, thereby causing the first and second alignment portions 180 and 182 to be always engaged without clearance. This engagement between the first and second alignment portions 180 and 182 without clearance can avoid creating a gap between the first and second alignment portions 180 and 182 and ensure the accurate alignment of the wire holder 116 relative to the housing 112.

Referring to FIGS. 6 and 7, an example structure of the extension receiving cavity 126 is described. FIG. 6 is a side cross-sectional view of an assembly of the housing 112, the contacts 114, and the wire holder 116, which engages the cable 104. FIG. 7 is a rear cross-sectional view of the assembly of FIG. 6 without the cable 104.

As illustrated in FIG. 6, the extension receiving cavity 126 is defined by a bottom surface (also referred to herein as a first surface) 170 and a top surface (also referred to herein as a second surface) 172 opposite to the bottom surface 170. The bottom surface 170 of the extension receiving cavity 126 is configured to receive and support the wire support extension 132 such that the wire support extension 132 seats on the bottom surface 170. The top surface 172 of the extension receiving cavity 126 can include a plurality of wire grooves 174 that corresponds to the plurality of wire receiving passages 156 to define a plurality of wire channels 176 configured to receive the wires 106, respectively.

The extension receiving cavity 126 further includes a plurality of inner mating portions 190 configured to engage forward ends 192 of the wires 106 and terminate the wires 106. An example structure of the inner mating portions 190 is illustrated and described in more detail with reference to FIGS. 10A and 10B.

The wires 106 of the cable 104 can be terminated in various manner using the housing 112, the contacts 114, and the wire holder 116 of the present disclosure. In some embodiments, the wires 106 of the cable 104 can be first inserted through the wire insert channels 136. For example, where four wire insert channels 136 are provided as illustrated in FIG. 3, eight wires 106 are paired into four groups (e.g., four twisted pairs of wires) that pass through the four wire insert channels 136, respectively, in various manners. Then, the wires 106 are respectively disposed on the wire receiving passages 156 of the wire support extension 132 of the wire holder 116. In some embodiments, the wires 106 extend over the wire trimming end 148 of the wire holder 116 when the wires 106 are placed on the wire receiving passages 156. The wire holder 116 supporting the wires 106 are inserted into the housing cavity 122 until the wire support extension 132 of the wire holder 116 is fully inserted into the extension receiving cavity 126 of the housing 112 and the extended tips (i.e., the forward ends 192) of the wires 106 contact the forward mating portions 190 of the extension receiving cavity 126.

Each of the contacts 114 has one or more contact insulation piercing tips 186. When the wire support extension 132 supporting the wires 106 is completely inserted into the extension receiving cavity 126 of the housing 112, the contact insulation piercing tips 186 of the contacts 114 are arranged above the wires 106 along the middle axes A (FIG. 7). In some embodiments, each contact 114 can has two contact insulation piercing tips 186 that are opposingly offset from each other with respect to the center line of the contact 114. As illustrated in FIGS. 8B and 9B, the contacts 114 can then be depressed through the contact insert slots 124 such that they pierce through the outer insulating layer 110 and make contact with the inner conductive core 108 of the wires 106.

Figure 8A:
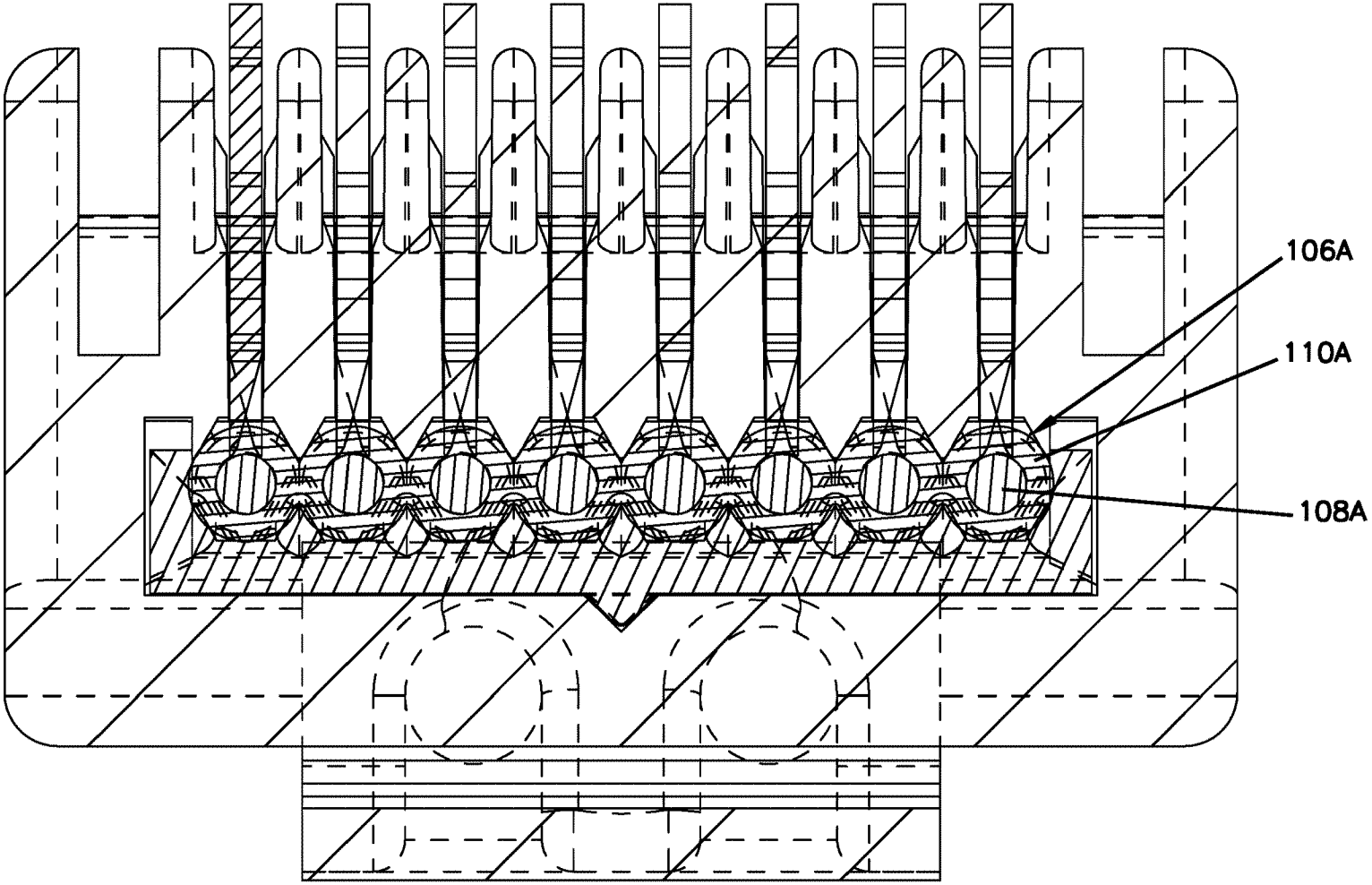
FIG. 8A is a rear cross-sectional view of the electric connector, illustrating a first cable disposed therein.
Figure 8B:
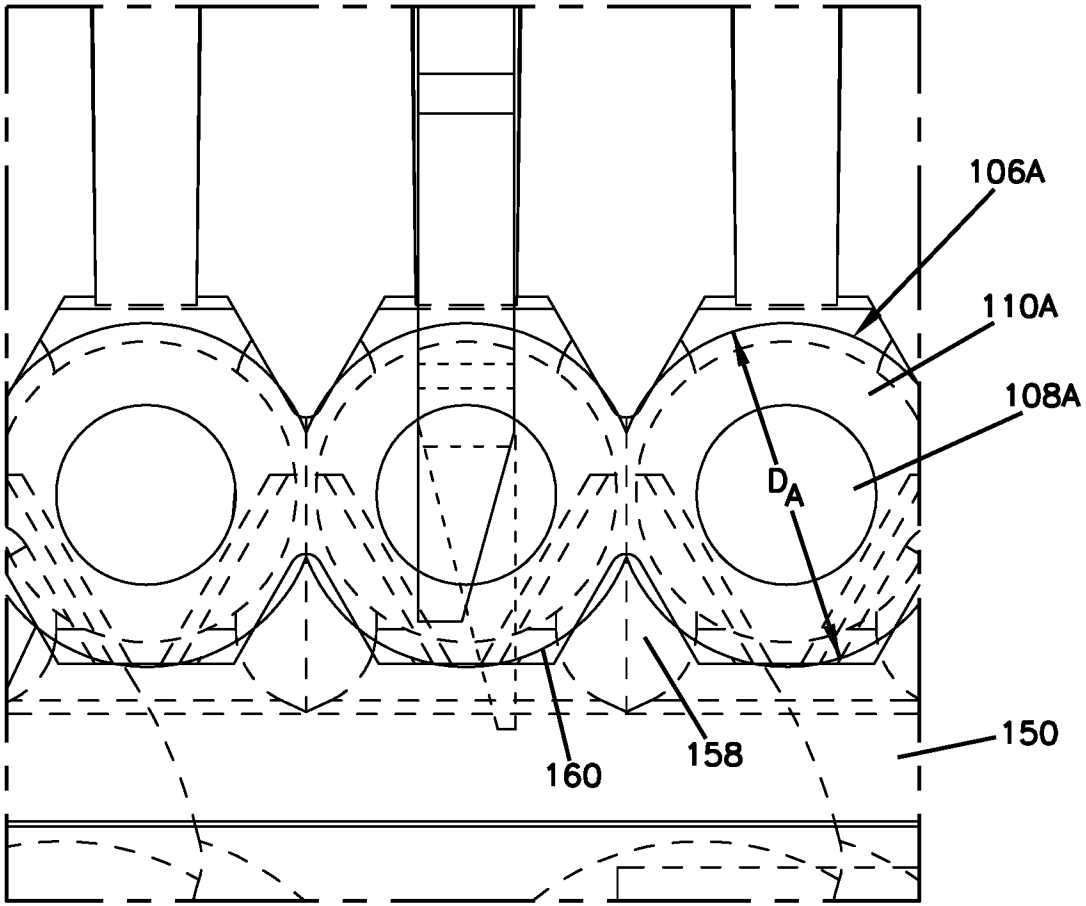
FIG. 8B is an enlarged rear cross-sectional view of the electric connector of FIG. 8A.

FIGS. 8A and 8B are rear cross-sectional views of the electric connector 102, illustrating a first cable 104A disposed therein. The first cable 104A is an example of the cable 104 as described above. The first cable 104A has a plurality of first wires 106A, each having a first diameter $D_A$. Each of the first wires 106A includes an inner conductive core 108A and an outer insulating layer 110A. As illustrated, the first diameter $D_A$ of the first wire 106A is greater than a distance defined between the opposing sides 168 of adjacent centralizing ribs 160 at any height from the lowest portions of the centralizing ribs 160. In this configuration, the centralizing ribs 160 are configured to be embedded at least partially into the outer insulating layers 110A of the first wire 106A when the wires 106A are pressed against the wire receiving passages 156 by the contacts 114 being depressed onto the first wires 106A.

Figure 9A:
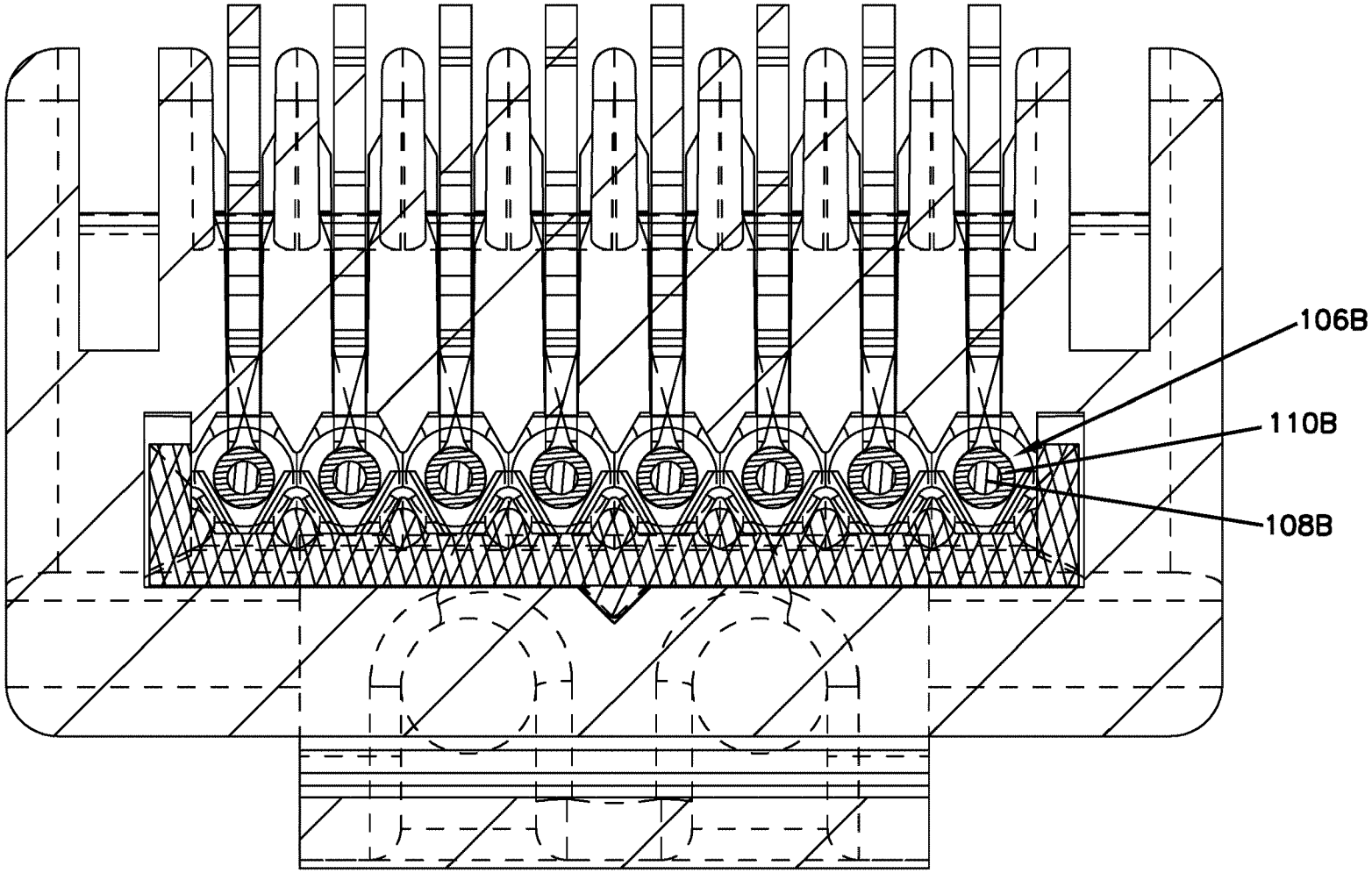
FIG. 9A is a rear cross-sectional view of the electric connector, illustrating a second cable disposed therein.
Figure 9B:
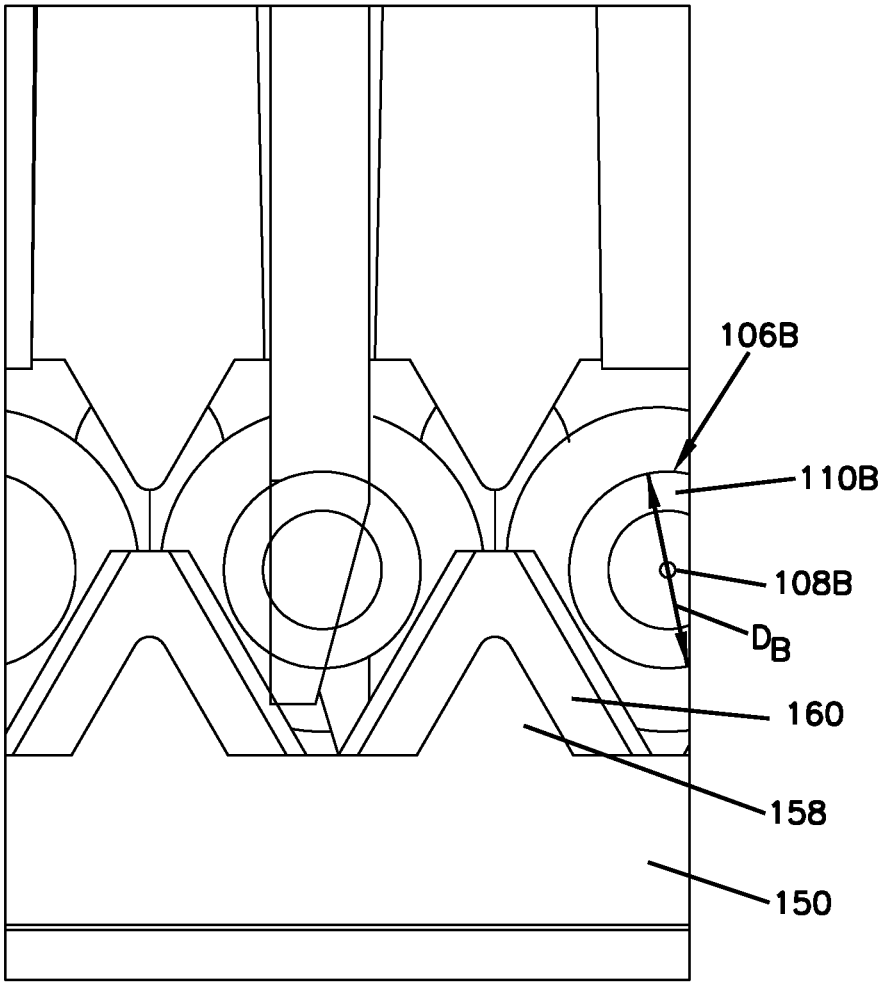
FIG. 9B is an enlarged rear cross-sectional view of the electric connector of FIG. 9A.

FIGS. 9A and 9B are rear cross-sectional views of the electric connector 102, illustrating a second cable 104B disposed therein. The second cable 104B is an example of the cable 104 as described above. The second cable 104B has a plurality of second wires 106B, each having a second diameter $D_B$. Each of the second wires 106B includes an inner conductive core 108B and an outer insulating layer 110B. The second diameter $D_B$ is smaller than the first diameter $D_A$. The centralizing ribs 160 are configured such that a width of the wire receiving passage 156 is defined smaller between the opposing sides 168 of adjacent centralizing ribs 160 within the wire receiving passages 156 than between the tapered lateral surfaces 159 of adjacent base protrusions 158. The centralizing ribs 160 are designed to centralize the second wires 106B of the second diameter $D_B$ along the middle axes A. In some embodiments, similarly to the first wires 106A, the centralizing ribs 160 can be embedded at least partially into the outer insulating layers 110B of the second wire 106B as the second wires 106B are pressed against the wire receiving passages 156.

Figure 10A:
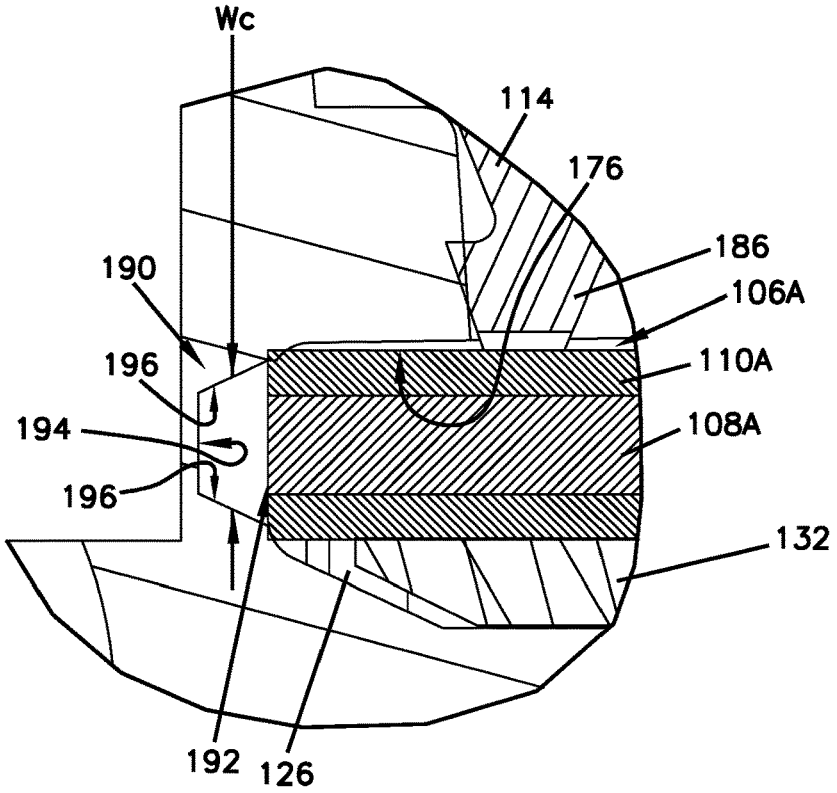
FIG. 10A is an exploded side cross-sectional view of an example inner mating portion engaging a first cable.
Figure 10B:
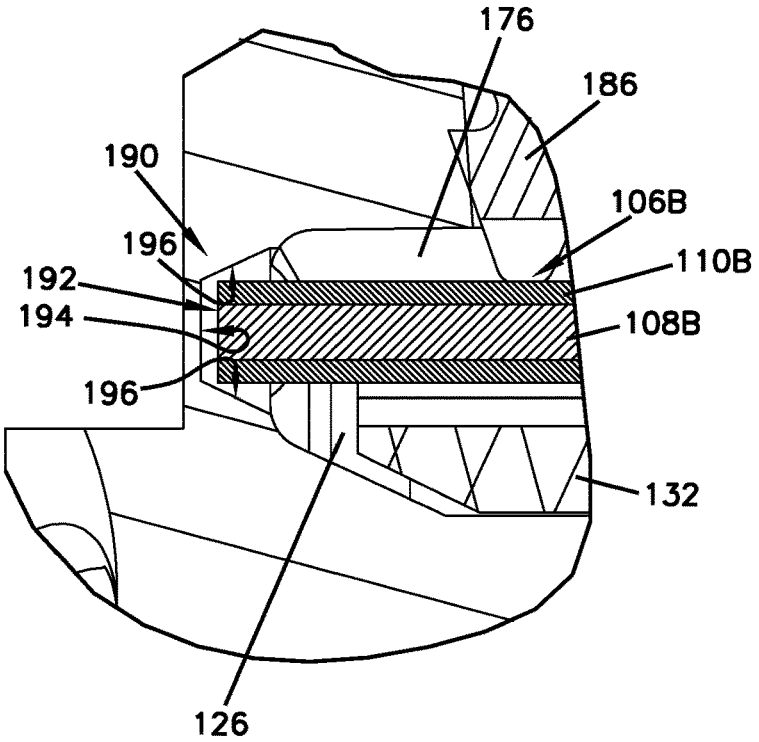
FIG. 10B is an exploded side cross-sectional view of an example inner mating portion engaging a second cable.

FIGS. 10A and 10B are exploded side cross-sectional views of the extension receiving cavity 126, illustrating an example structure of the inner mating portions 190 thereof.

The plurality of inner mating portions 190 is formed at a forward end of the extension receiving cavity 126 and configured to terminate the forward ends 192 of the wires 106. The inner mating portions 190 are configured to secure the wires 106 of different diameters at the forward ends 192 thereof, such as the first wires 106A and the second wires 106B.

Each of the inner mating portions 190 is conically tapered to engage the forward ends 192 of the wires 106, which have different diameters. In some embodiments, each of the inner mating portions 190 includes a mating end surface 194 and a circumferential side surface 196. The circumferential side surface 196 can be configured to have a truncated cone shape in a cross-sectional view, such as shown in FIGS. 10A and 10B. For example, a width We of the circumferential side surface 196 is configured to decrease in a longitudinal direction as it is close to the mating end surface 194 along a corresponding wire channel 176.

The truncated cone shape of the inner mating portions 190 can engage the wires 106 of different diameters and secure them in place. As illustrated in FIG. 10A, a wider portion of the circumferential side surface 196 away from the mating end surface 194 can engage the forward end 192 of the first wire 106A having the first diameter $D_A$ as the first wire 106A is disposed in the wire channel 176. As illustrated in FIG. 10B, a narrower portion of the circumferential side surface 196 close to the mating end surface 194 can engage the forward end 192 of the second wire 106B having the second diameter $D_B$ as the second wire 106B is disposed in the wire channel 176. If the forward end 192 of the second wire 106B is equal to, or smaller than, a size (e.g., a diameter) of the mating end surface 194, the mating end surface 194 can engage the forward end 192 of the second wire 106B as the second wire 106B is disposed in the wire channel 176.

As described herein, the electric connector 100 in accordance with the present disclosure is assembled by inserting wires of the cable into the wire insert channels 136 of the wire holder 116; arranging the wires on the wire support extension 132 of the wire holder 116; and engaging the wire holder 116 with the housing 112 by inserting the wire support extension 132 of the wire holder 116 into the extension receiving cavity 126 of the housing 112. As described herein, the wire support extension 132 includes the plurality of wire receiving passages 156 configured to arrange wires of a first cable thereon and centralize the wires of the first cable along middle axes A of the wire receiving passages 156. The plurality of wire receiving passages 156 is aligned to the plurality of contact insert slots 124 of the housing 112. The wire holder 116 includes the plurality of wire support ribs 160 at least partially arranged on the plurality of wire receiving passages 156 and configured to arrange wires of a second cable on the plurality of wire receiving passages 156 and centralize the wires of the second cable among the middle axes A of the wire receiving passage 156. The wires of the second cable have a diameter smaller than a diameter of the wires of the first cable. The method of assembling the electric connector 100 can further include a step of inserting the plurality of contacts 114 into the plurality of contact insert slots 124 until the contact insulation piercing tips 186 pierce through outer insulating layers of the wires to make contact with inner conductive cores of the wires.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

LIST OF REFERENCE NUMERALS AND CORRESPONDING FEATURES

100 electric connector assembly
102 electric connector
104A first cable
104B second cable
104 cable
106A first wire
106B second wire
106 wire
108A inner conductive core
108B inner conductive core
108 conductive core
110A outer insulating layer
110B outer insulating layer
110 insulating layer
112 housing
114 contacts
116 wire holder
118 shield cap
120 strain relief boot
122 housing cavity
124 contact insert slots
126 extension receiving cavity
128 grooves
130 holder body
132 wire support extension
136 wire insert channels
138 coupling tabs
140 side walls
142 side walls
144 forward end
148 wire trimming end
150 base portion
152 top surface
154 bottom surface
156 wire receiving passages
158 base protrusions
159 tapered lateral surfaces
160 centralizing ribs
162 lower edges
164 middle points
166 lower edges
168 opposing sides
170 bottom surface
172 top surface
174 wire grooves
176 wire channel
180 first alignment portion
182 second alignment portion
186 contact insulation piercing tips
190 inner mating portion
192 forward end
194 mating end surface
196 circumferential side surface
202 front side of contact
204 lateral side of contact

What is claimed is:

1. An electric connector comprising:
a plurality of contacts
a wire holder including:
a wire support extension;
a plurality of wire receiving passages provided on the wire support extension; and
a plurality of wire support ribs arranged at least partially in the plurality of wire receiving passages and configured to arrange wires of a cable on the plurality of wire receiving passages and align the wires of the cable with the plurality of contact insert slots;
wherein the wires of the cable include an inner conductive core and an outer insulating layer surrounding the inner conductive core, and
wherein the plurality of wire support ribs is configured to be embedded at least partially into the outer insulating layers of the cable when the wires of the cable are pressed onto the plurality of wire receiving passages.

2. The electric connector according to claim 1, wherein the wire holder includes at least one wire insert channel through which the wires of a cable are inserted before the wires are disposed on the wire support extension.

3. The electric connector according to claim 1, wherein:
the wire holder includes at least one coupling tab; and
the housing includes at least one groove corresponding to the at least one coupling tab of the wire holder and configured to secure the wire holder to the housing.

4. The electric connector according to claim 1, wherein:
the plurality of contacts comprises contact insulation piercing tips configured to be arranged above the wires of the cable at the middle axes of the wire receiving passages; and
the contact insulation piercing tips pierce through outer insulating layers of the wires to make contact with inner conductive cores of the wires when the plurality of contacts are depressed through plurality of contact insert slots.

5. The electric connector according to claim 1, wherein:
the wire holder includes a first alignment portion formed in the wire support extension; and
the housing includes a second alignment portion, the second alignment portion configured to engage the first alignment portion of the wire holder when the wire support extension of the wire holder is inserted into the extension receiving cavity of the housing to align the plurality of contact insert slots with the plurality of wire receiving passages of the wire holder.

6. The electric connector according to claim 1, wherein the wire support extension of the wire holder comprise:
a base portion having a first surface and a second surface opposite to the first surface; and
a plurality of base protrusions extending from the first surface of the base portion and arranged in parallel to define the plurality of wire receiving passages,
wherein the plurality of wire support ribs is at least partially formed around the plurality of base protrusions.

7. The electric connector according to claim 6, wherein:
the wire holder includes an alignment protrusion formed in the second surface of the base portion of the wire support extension; and the housing includes an alignment groove, the alignment groove configured to engage the alignment protrusion of the wire holder when the wire support extension of the wire holder is inserted into the extension receiving cavity of the housing to align the plurality of contact insert slots with the plurality of wire receiving passages of the wire holder.

8. The electric connector according to claim 1, further comprising:

a housing including an extension receiving cavity defining a plurality of wire channels with the plurality of wire receiving passages of the wire holder, the plurality of wire channels configured to receive wires of a cable and terminating at a plurality of inner mating portions configured to engage forward ends of the wires of the cable; and each of the plurality of inner mating portions is conically tapered to engage forward ends of wires having different diameters.

9. The electric connector according to claim 8, wherein each of the inner mating portions has a mating end surface and a circumferential side surface, a width of the circumferential side surface configured to decrease in a longitudinal direction toward the mating end surface along the corresponding wire channel.

10. The electric connector according to claim 8, wherein the extension receiving cavity has a first surface and a second surface opposing to the first surface, the first surface configured to support the wire support extension of the wire holder, and the second surface including a plurality of wire grooves that corresponds to the plurality of wire receiving passages of the wire support extension to define the plurality of wire channels.

11. An electric connector comprising:

a housing including an extension receiving cavity and a plurality of contact insert slots;

a plurality of contacts configured to be at least partially inserted to the plurality of contact insert slots; and a wire holder including a wire support extension configured to be at least partially inserted to the extension receiving cavity, the wire support extension including a plurality of wire receiving passages configured to be aligned to the plurality of contact insert slots when the wire support extension is inserted to the extension receiving cavity, wherein the extension receiving cavity defines a plurality of wire channels with the plurality of wire receiving passages of the wire holder, the plurality of wire channels configured to receive wires of a cable and terminating at a plurality of inner mating portions defined within an end wall of the housing and configured to engage forward ends of the wires of the cable, and wherein each of the plurality of inner mating portions is tapered within the end wall to engage forward ends of wires.

12. The electric connector according to claim 11, wherein each of the inner mating portions of the wire channels has a mating end surface and a circumferential side surface forming a truncated cone, a diameter of the circumferential side surface configured to decrease in a longitudinal direction toward the mating end surface along the corresponding wire channel.

13. The electric connector according to claim 11, wherein the wire holder includes at least one wire insert channel through which the wires of a cable are inserted before the wires are disposed on the wire support extension.

14. The electric connector according to claim 11, wherein:

the wire holder includes at least one coupling tab; and the housing includes at least one groove corresponding to the at least one coupling tab of the wire holder and configured to secure the wire holder to the housing.

15. The electric connector according to claim 11, wherein:

the plurality of contacts comprises contact insulation piercing tips configured to be arranged above the wires of the first or second cable at the middle axes of the wire receiving passages; and the contact insulation piercing tips pierce through outer insulating layers of the wires to make contact with inner conductive cores of the wires when the plurality of contacts are depressed through plurality of contact insert slots.

16. The electric connector according to claim 11, wherein the plurality of wire receiving passages is configured to support wires of a cable and align the wires of the cable with the plurality of contact insert slots.

17. The electric connector according to claim 16, wherein the extension receiving cavity has a first surface and a second surface opposing to the first surface, the first surface configured to support the wire support extension of the wire holder, and the second surface including a plurality of wire grooves that corresponds to the plurality of wire receiving passages of the wire support extension to define the plurality of wire channels.

* * * * *